US005329288A

United States Patent [19]

Kim

[11] Patent Number: 5,329,288

[45] Date of Patent: Jul. 12, 1994

[54] FLAT-PANEL DISPLAY DEVICE

[75] Inventor: Sang-cheol Kim, Kyunggi, Rep. of Korea

[73] Assignee: Samsung Electron Devices Co., Ltd., Kyunggi, Rep. of Korea

[21] Appl. No.: 820,976

[22] Filed: Jan. 15, 1992

[30] Foreign Application Priority Data

Sep. 28, 1991 [KR] Rep. of Korea ..... 91-17019

[51] Int. Cl.[5] ..... G09G 3/10

[52] U.S. Cl. ..... 345/63; 345/211

[58] Field of Search ..... 340/793, 771, 776, 784, 340/805, 813, 814; 345/60, 61, 63, 62, 211, 212

[56] References Cited

U.S. PATENT DOCUMENTS

| | | | |
|---|---|---|---|
| 4,257,045 | 3/1981 | Miles | 340/784 |
| 4,642,524 | 2/1987 | Eaton et al. | 340/781 |
| 4,683,470 | 7/1987 | Criscimasna | 340/771 |
| 4,818,982 | 4/1989 | Kuehn et al. | 340/781 |
| 5,119,085 | 6/1992 | Yamazaki | 340/784 |
| 5,122,783 | 6/1992 | Bassetti, Jr. | 340/701 |

*Primary Examiner*—Alvin E. Oberley
*Assistant Examiner*—Steven J. Saras
*Attorney, Agent, or Firm*—Leydig Voit & Mayer

[57] ABSTRACT

A flat-panel display device is disclosed which comprises m column electrodes, n row electrodes, a column electrode driver for driving the m column electrodes in response to pixel data, and a row electrode driver for driving the n row electrodes by a one-line-at-a-time scanning methode, the column electrode driver comprising a detector for checking whether or not the number of turned-on column electrodes among the m column electrodes is greater than a predetermined number and an on-time varying unit for shortening the on-time of the column electrodes in response to the output of the detector. The device has an effect of reducing power consumed by varying the on-time of the electrodes when more than the predetermined number of pixels are on.

6 Claims, 5 Drawing Sheets

FLAT-PANEL DISPLAY DEVICE

BACKGROUND OF THE INVENTION

The present invention relates to a flat-panel display device, and more particularly to a driver for the flat-panel display device.

Cathode ray tubes are thick and heavy for the large-screen televisions now being actively researched. This requires the development of a flat-panel display devices which, are better suited to the cathode ray tubes.

Among flat-panel display devices, plasma display devices have good display quality but consume a great amount of power. To overcome this disadvantage, conventionally, a current-limiting resistor is replaced with a constant current source which reduces the power consumed when using the current-limiting resistor. But, the reduced amount of power is not significant for a laptop computer which employs the flat-panel display device and is driven by a battery. Further, when many pixels are turned on, the total current flowing through the pixels increases which reduces voltage by increasing the voltage drop across a resistor, so that the potential difference between anode and cathode electrodes of each pixel decreases. When this happens, the current as well as the luminance of the pixels also decreases.

Thus, according to a conventional driver regardless of whether power is consumed by a luminance-limiting resistor, the pixel luminance reduces to suppress the rise in temperature of the pixels. However, this driver is ineffective in reducing the overall power consumption.

SUMMARY OF THE INVENTION

Therefore, it is an object of the present invention to provide a flat-panel display device which is capable of reducing the consumed power by varying anode-on-time so as to limit the increase in current when many pixels are turned on.

It is another object of the present invention to provide a flat-panel display device which easily adapts to battery operation.

To accomplish these objects, a flat-panel display device comprises m column electrodes, n row electrodes, a column electrode driver for driving the m column electrodes in response to pixel data, and a row electrode driver for driving the n row electrodes by a one-line-at-a-time scanning method, the column electrode driver comprising a detector for checking whether or not the number of turned-on column electrodes among the m column electrodes is more than a predetermined number and an on-time varying unit for shortening the on-time of the column electrodes in response to the output of the detector.

BRIEF DESCRIPTION OF THE DRAWINGS

The above objects and other advantages of the present invention will become more apparent by describing in detail a preferred embodiment of the present invention with reference to the attached drawings in which.

DETAILED DESCRIPTION OF THE INVENTION

Figure 1:
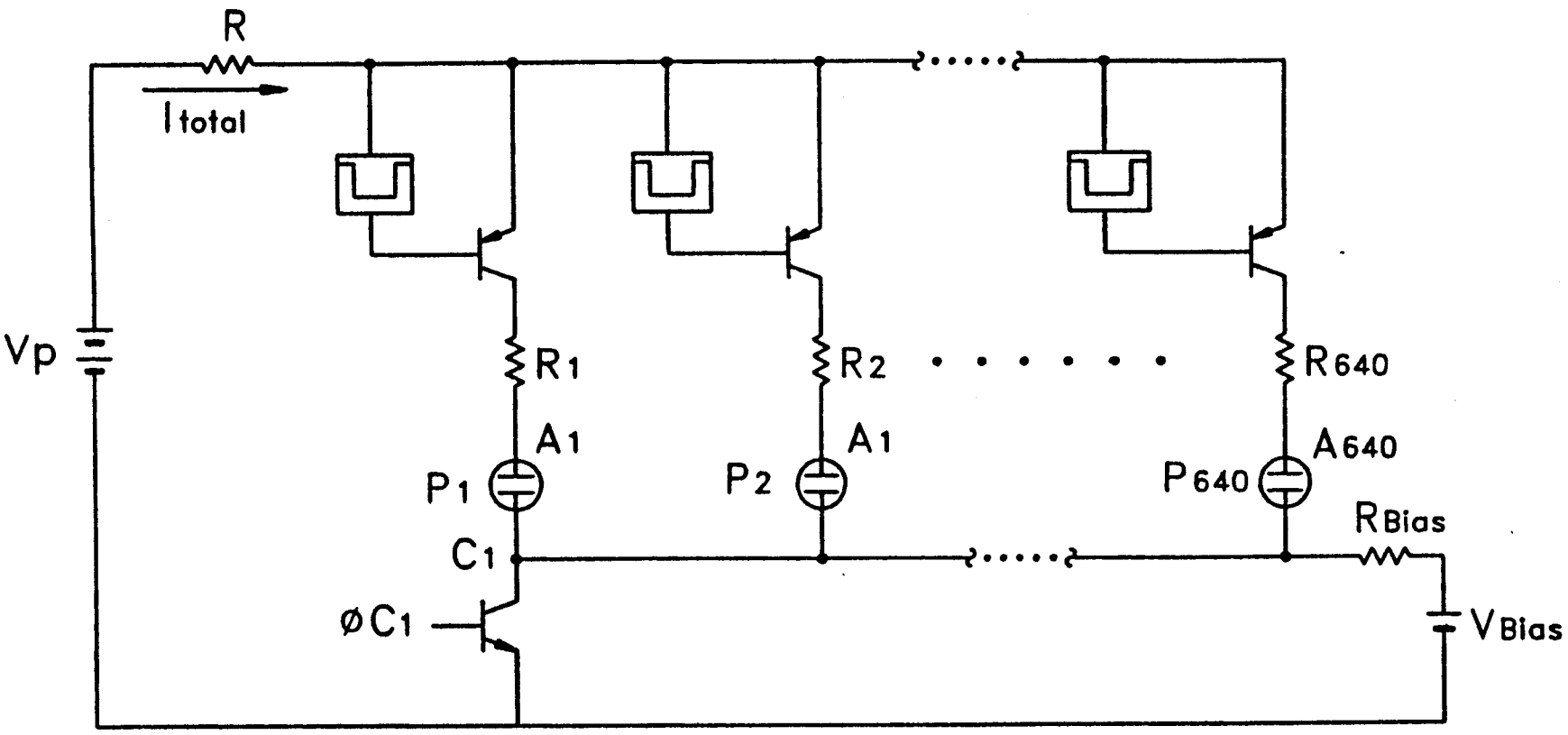
FIG. 1 (PRIOR ART)
FIG. 1 shows a driver for a conventional flat-panel display device.

First, a driver for a conventional flat-panel display device will be described below;

FIG. 1 illustrates one row of a flat-panel display device having 640×480 pixels. Referring to FIG. 1, one side of a luminance-limiting resistor R is connected to the positive electrode of voltage Vp, and the other side is connected to anode on-time circuits for controlling the anode on-time of each of the 640 pixels of one row and emitters of transistors controlled by the outputs of the anode on-time circuits. The collector of each anode on-time circuit is connected to one side of resistors $R_1$, $R_2$ . . . , and $R_{640}$, the other ends of resistors $R_1$, $R_2$ . . . , and $R_{640}$ are connected to anode electrodes $A_1$, $A_2$ . . . , and $A_{640}$. Cathode electrode $C_1$ of every pixel is commonly connected to the collector of a driving transistor for driving one row. A pulse $\phi C_1$ is applied to the base of the driving transistor, and the emitter of the driving transistor is connected to the negative electrode of voltage Vp. The common point of the cathode of every pixel is also connected to a bias resistor $R_{Bias}$ whose other side is connected to the emitter of the driving transistor.

According to the construction, a row driving pulse $\phi C_1$ for driving one row of pixels is input, turning on the driving transistor. In response to an anode on-time signal for each pixel, each pixel emits light. Here, total power P consumed by luminance-limiting resistor R when many pixels are turned on, is represented by the below expression.

$$P = R \times I_{total}2 \times \frac{T_{on}}{T_{total}}$$

where $I_{total}$=total circuit current, $T_{on}$=number of pixels that are turned on, and $T_{total}$=total number of pixels.

As shown in the expression, pixel luminance decreases to suppress the rise in temperature, but the overall power consumed is not greatly reduced.

Now, an anode driver for driving anodes of the plasma display device of the present invention will be described below.

Figure 2:
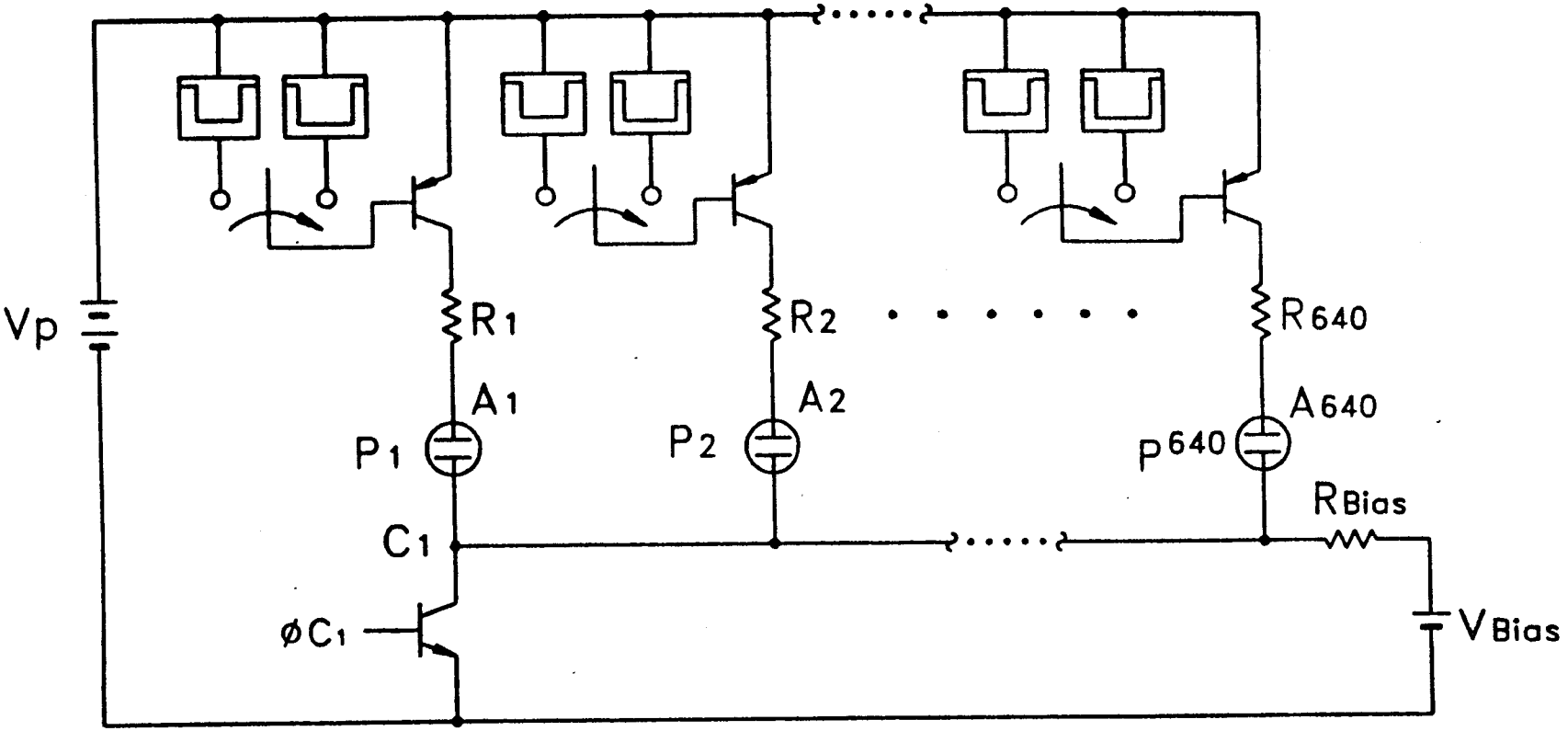
FIG. 2 illustrates a driver for a flat-panel display device of the present invention.

Referring to FIG. 2, the limiting resistor of the conventional circuit has been eliminated, and more anode on-time circuits are provided for reducing the anode on-time when many pixels are on among the 640 pixels of one row. Thus, power P when many pixels are on is represented by the below expression.

$$P = V_p \times I_{total} \times \frac{T_{on}}{T_{total}}$$

Here, since the overall on-time of a pixel is reduced and no power is consumed by resistor R of FIG. 1, power consumption decreases.

Figure 3:
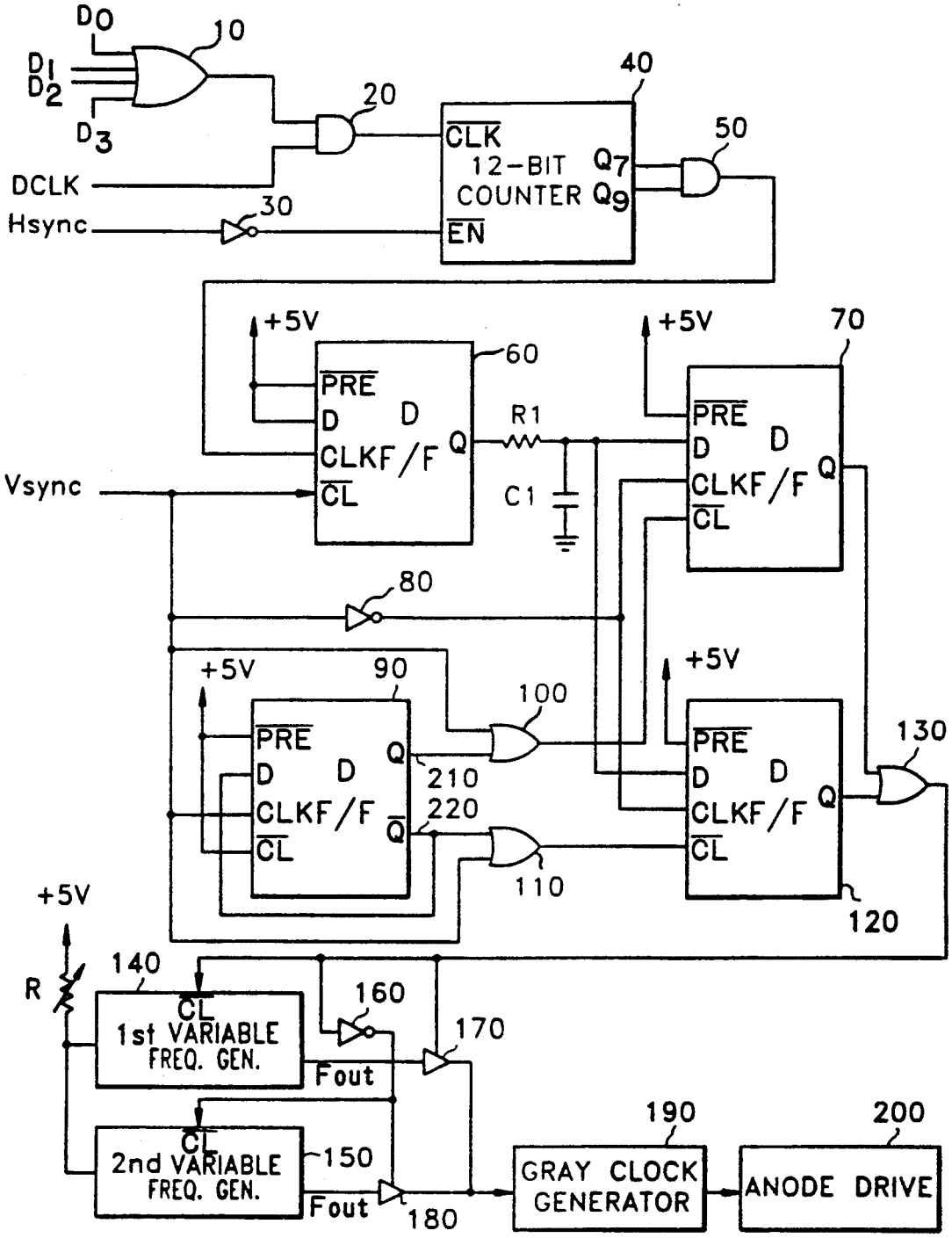
FIG. 3 illustrates an anode on-time circuit for the driver of the present invention.

FIG. 3 illustrates an embodiment of a circuit having two anode on-time circuits to realize the present invention. More specifically, it is supposed that one row has 640 pixels and one pixel has four bits. The circuit of FIG. 3 reduces anode on-time during a next vertical scanning period when the number of turned-on pixels in one row are more than 320.

Here, an OR gate 10 inputs data input signals $D_0$, $D_1$, $D_2$, and $D_3$, and an AND gate 20 receives the output of the OR gate and a data enable clock signal DCLK. A 12-bit counter 40 receives the output of AND gate 20 at a clock signal port $\overline{CLK}$ and a horizontal synchronous signal Hsync inverted by an inverter 30 at an enable port $\overline{EN}$. An AND gate 50 receives the signals from output ports $Q_7$ and $Q_9$ of the 12-bit counter.

A D flip-flop 60 with positive edge trigger receives the output signal of AND gate 50 at a clock signal port CLK. A preset port $\overline{PRE}$ and a data input port D thereof are commonly connected to +5 V supply voltage. A vertical synchronous signal Vsync is applied to a clear signal port $\overline{CL}$. The Q output of D flip-flop 60 is connected to one side of resistor R1 whose other end is connected to one side of capacitor C1. The other end of capacitor C1 is grounded.

A data input port D of a D flip-flop 70 also with a positive edge trigger is connected to the common point between resistor R1 and capacitor C1 and preset port $\overline{PRE}$ is connected to power voltage (+5 V). Its clock port CLK receives vertical synchronous signal Vsync after it is inverted by an inverter 80.

An OR gate 100 receives vertical synchronous signal Vsync and the Q output of a positive-edge-triggered D flip-flop 90, while an OR gate 110 receives the vertical synchronous signal and the $\overline{Q}$ output of D flip-flop 90. The output of OR gate 100 is connected to a clear port $\overline{CL}$ of D flip-flop 70.

A preset port $\overline{PRE}$ of a D flip-flop 120 with positive edge trigger is connected to the supply voltage (+5 V). Its data input port D is connected to the common point between resistor R1 and capacitor C1. Clock port CLK thereof is connected to the output of inverter 80, and a clear port $\overline{CL}$ is connected to the output of OR gate 110. An OR gate 130 is connected to the Q outputs of D flip-flops 70 and 120.

A clear port $\overline{CL}$ of a first variable frequency generator 140 is connected to the output of OR gate 130. Further, a clear port $\overline{CL}$ of a second variable frequency generator 150 receives the output of OR gate 130 after it is inverted by an inverter 160. Power voltage (+5 V) is connected to the power supply port of first and second variable frequency generators 140 and 150 through variable resistor R. The control port of tri-state buffer 170 is connected to the output port of OR gate 130, while its input is connected to the output of first variable frequency generator 140. Also, a control port of a tri-state buffer 180 is connected to the output of inverter 160, while its input is connected to the output of second variable frequency generator 150.

Finally, the input of a gray clock generator 190 is connected to the outputs of tri-state buffers 170 and 180. The input of an anode driving circuit 200 is connected to the output of gray clock generator 190.

Figure 4:
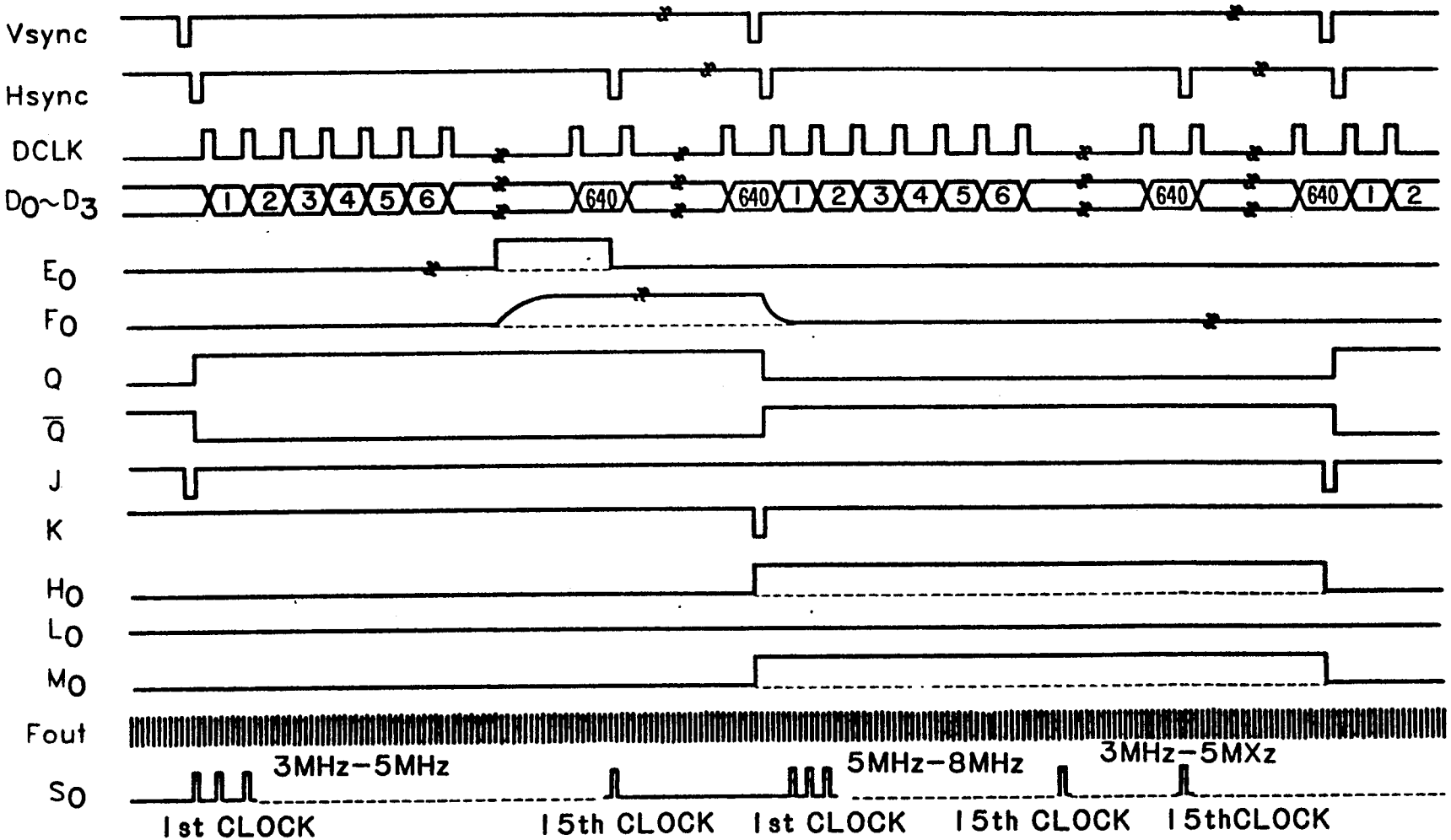
FIG. 4 is a timing diagram for illustrating the operation of FIG, 3.

Operation of FIG. 3 will be described with reference to FIG. 4. One solid line of this timing diagram represents a case where more than 320 pixels are on, and the timing diagram in a dotted-line represents a case where less than 320 pixels are turned on.

OR gate 10 outputs a "HIGH" signal when at least one bit among 4-bit pixel data $D_0$ to $D_3$ is "HIGH". And gate 20 receives data clock DCLK and the output of OR gate 10, and outputs a "HIGH" signal when both of these two signals are "HIGH". 12-bit counter 40 is enabled when an inverted horizontal synchronous signal Hsync applied to its enable port $\overline{EN}$ is "LOW", and counts by incrementing by one when the output of AND gate 20 switches from "HIGH" to "LOW". When the 12-bit counter counts so that 320 among the 640 pixels of one horizontal line are on, the seventh and ninth bits become "HIGH". And gate 50 outputs "HIGH" signal when the seventh and ninth bits are "HIGH". However, when the number of turned-on pixels of one line are below 320, the output of AND gate 50 is "LOW". When the output of AND gate 50 switches from "LOW" to "HIGH", D flip-flop 60 feeds a "HIGH" signal to its Q output. D Flip-flop 60 is cleared when vertical synchronous signal Vsync becomes "LOW". Resistor R1 and capacitor C1 delay the output signal of D flip-flop 60.

D flip-flop 70 inputs the signal delayed by resistor R1 and capacitor C1, and outputs a "HIGH" signal when an inverted vertical synchronous signal Vsync switches from "LOW" to "HIGH". The D flip-flop 90 outputs a pulse signal Q triggered when vertical synchronous signal Vsync switches from "LOW" to "HIGH". When vertical synchronous signal Vsync and pulse signal Q are both "LOW", OR gate 100 outputs a "LOW" signal. When vertical synchronous signal Vsync and an inverted pulse signal $\overline{Q}$ from D flip-flop 90 are both "LOW", OR gate 110 outputs a "LOW" signal. D flip-flop 120 outputs the same signal as D flip-flop 70, and is cleared by the output signal from OR gate 110, thereby maintaining a "LOW" output state. When the outputs of D flip-flops 70 and 120 are both "LOW", OR gate 130 outputs a "LOW" signal. More specifically, when the number of turned-on pixels is below 320, OR gate 130 outputs a "LOW" signal, and when the number of turned-on pixels is greater than or equal to 320, OR gate 130 outputs a "HIGH" signal. When the output of OR gate 130 is "LOW", first variable frequency generator 140 is cleared and a variable frequency from 3 MHz to 5 MHz is generated from second variable frequency generator 150. When the output of OR gate 130 is "HIGH", second variable frequency generator 150 is cleared and a variable frequency from 5 MHz to 8 MHz is generated from first variable frequency generator 140. When the 3 MHz–5 MHz variable frequency is input via tri-state buffer 180, gray clock generator 190 generates a normal gray clock to provide normal clock on-time. However, if a 5 MHz to 8 MHz signal is input via tri-state buffer 170, the gray on-time is shortened to be less than the normal time.

Therefore, when the number of turned-on pixels is greater than or equal to 320, the overall power consumed can be reduced by reducing the gray clock on-time and providing it to the anode driving circuit. According to the present invention, power is reduced during a next vertical scanning period.

Figure 5:
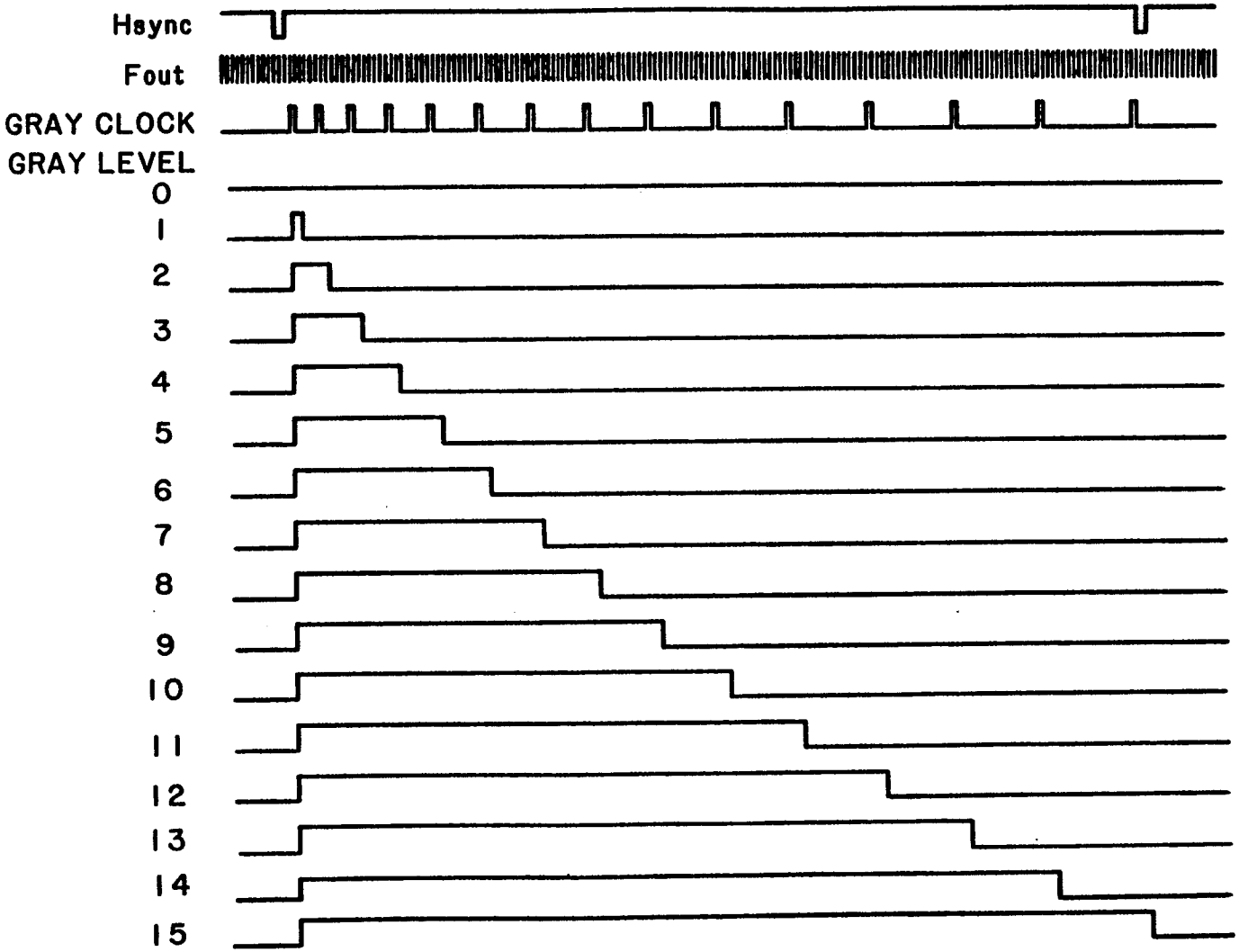
FIG. 5 illustrates on-time waveform diagrams according to a gray clock and gray levels of input data, when the output frequency of a frequency generator is between 3 MHz and 5 MHz.

FIG. 5 illustrates on-time waveforms according to gray clocks and gray levels generated when the output frequency of a frequency generator is 3 MHz to 5 MHz. Referring to FIG. 5, the more the gray level increases, the more the on-time increases. When a frequency between 5 MHz and 8 MHz is input, the gray clock is generated prior to one horizontal frequency period, and on-time according to the gray levels is reduced to be less than that when the input frequency is 3 MHz to 5 MHz.

In a flat-panel display device consuming a large amount of power, the present invention has an effect of reducing power consumed by varying the on-time of the first electrode when more than the predetermined number of pixels are on.

Further, the circuit of the present invention is not confined to the embodiment having only two variable frequencies, but may have many variable frequencies as required.

What is claimed is:

1. A flat-panel display device having first and second electrodes for displaying n×m pixel data, comprising:

a first driver for driving the first electrodes responsive to a first signal;

means for controlling the number of pixels to determine whether or not the number of turned-on pixels in one row among m rows is at least equal to a predetermined number, said means for counting including:

first logic means for determining whether any bit of pixel data is on, second logic means for generating a counter clock signal responsive to the output of said first logic means and a data clock signal.

a counter for counting the number of pixels in the on state utilizing the output of said second logic means, and third logic means for determining whether the predetermined number of pixels in the on state has been counted;

means for generating a first frequency signal in response to first preselected outputs of said counting means, said means for generating a first frequency signal including:

a first D-type positive-edge-triggered flip-flop having a clock signal port connected to said third logic means, a preset signal port, a data input port, and a clear signal port which receives a second signal, delaying means for delaying the output of said first D-type positive-edge-triggered flip-flop, a second D-type positive-edge-triggered flip-flop having a data input port connected to said delaying means to receive the output signal of said delaying means, and a clock signal port for receiving an inverted second signal; and means for generating a first frequency in response to an output signal from said second D-type positive-edge-triggered flip-flop;

means for generating a second frequency signal in response to second preselected outputs of said counting means; and means for varying the on-time of the first electrodes in response to the first and second frequency signals.

2. The flat-panel display device as claimed in claim 1, wherein said means for generating a second frequency signal comprises:

a third D-type positive-edge-triggered flip-flop for receiving a second signal at a clock signal port, having a data input port connected to an inverting data output port;

fourth logic means for logically adding the second signal to the output of said third D-type positive-edge-triggered flip-flop and supplying the result to said second D-type positive-edge-triggered flip-flop;

fifth logic means for logically adding the second signal to the inverted output signal of said third D-type positive-edge-triggered flip-flop;

a fourth D-type positive-edge-triggered flip-flop having a data input port connected to said delaying means and an inverting clear port connected to said fifth logic means;

sixth logic means for logically adding the output signal of said fourth D-type positive-edge-triggered flip-flop to the output signal of said second D-type positive-edge-triggered flip-flop; and means for generating a second frequency in response to the output signal of said sixth logic means.

3. The flat-panel display device as claimed in claim 2, wherein said means for varying the on-time of said first electrode comprises:

a clock generator for generating a clock signal in response to a signal from said first or second frequency generator; and a first electrode on-time varying circuit for varying the on-time of said electrode in response to the signal from said clock generator.

4. The flat-panel display device as claimed in claim 3, wherein said first signal is a horizontal synchronous signal.

5. The flat-panel display device as claimed in claim 4, wherein said second signal is a vertical synchronous signal.

6. A displaying method for a flat-panel display device including a display having first and second electrodes for displaying n columns X m rows of pixels data, a first driver for driving said first electrode, and a second driver for driving said second electrode, comprising the steps of:

counting a number of turned-on pixels in one row among the m rows;

comparing the number of pixels counted in said counting step with a predetermined number;

providing a first on-time signal to the first driver when the number of pixels counted in said counting step is at least equal to the predetermined number;

outputting a second on-time signal to the first driver when the number of pixels counted in said counting step is less than predetermined number; and maintaining the pixels counted in said counting step in a turned-on state for a first time interval responsive to the first on-time signal and maintaining the pixels counted in said counting step in a turned-on state for a second time interval responsive to a second on-time signal wherein the first time interval is less than the second time interval.

* * * * *

UNITED STATES PATENT AND TRADEMARK OFFICE

CERTIFICATE OF CORRECTION

PATENT NO. : 5,329,288

DATED : July 12, 1994

INVENTOR(S) : KIM

It is certified that error appears in the above-indentified patent and that said Letters Patent is hereby corrected as shown below:

Claims:

Column 5, line 12, change "controlling" to --counting--;
line 21, change "." to --,--;

Column 6, line 51, after "than" insert --the--.

Signed and Sealed this

Eleventh Day of October, 1994

*Attest:*

*Attesting Officer*

BRUCE LEHMAN

*Commissioner of Patents and Trademarks*